US006543663B1

(12) United States Patent
Davis

(10) Patent No.: US 6,543,663 B1
(45) Date of Patent: Apr. 8, 2003

(54) AUTOMATIC FASTENING SCHEDULER

(76) Inventor: David M. Davis, P.O. Box 18852, Tucson, AZ (US) 85731

( * ) Notice: Subject to any disclaimer, the term of this patent is extended or adjusted under 35 U.S.C. 154(b) by 0 days.

(21) Appl. No.: 09/705,362

(22) Filed: Nov. 3, 2000

Related U.S. Application Data

(60) Provisional application No. 60/163,431, filed on Nov. 3, 1999.

(51) Int. Cl.[7] ..... B27F 7/00

(52) U.S. Cl. ..... 227/2; 227/7; 227/111; 173/124; 173/205

(58) Field of Search ..... 227/2, 66, 111, 227/7, 110, 129; 173/124, 205

(56) References Cited

U.S. PATENT DOCUMENTS 3,581,967 A * 6/1971 Benson ..... 227/112
3,771,708 A * 11/1973 De Nicola et al. ..... 227/111
3,796,365 A * 3/1974 Downing ..... 227/111
3,935,983 A * 2/1976 Buttriss ..... 227/110
3,984,040 A * 10/1976 Fry ..... 227/111
4,036,422 A * 7/1977 Harvey ..... 227/110
4,084,738 A * 4/1978 Schneider ..... 227/111
4,349,142 A * 9/1982 Soter, III ..... 112/153
4,657,167 A * 4/1987 Mays ..... 227/110
5,062,562 A * 11/1991 Michael ..... 227/111
5,181,643 A * 1/1993 Radtke ..... 227/110

* cited by examiner

*Primary Examiner*—Scott A. Smith
*Assistant Examiner*—Chukwurah Nathaniel
(74) *Attorney, Agent, or Firm*—Dale F. Regelman

(57) ABSTRACT

An automatic fastening scheduler apparatus is described for scheduling the placement of fasteners such as nails, staples or screws for joining materials along a preselected path on the material. The apparatus spaces the fasteners by sequentially operating the safety mechanism of a standard power fastener at a rate determined by the distance the apparatus is rolled along the surface of the material. The apparatus does not modify the operation of the safety mechanism of the power fastener and the power fastener can be easily removed from the apparatus for manual operation. The apparatus provides for varying the spacing between adjacent fasteners and can be operated from either an upright or a crouched position.

12 Claims, 8 Drawing Sheets

AUTOMATIC FASTENING SCHEDULER

RELATED APPLICATIONS

This application is based upon my provisional application No. 60/163,431 filed Nov. 3, 1999.

TECHNICAL FIELD

The present invention relates to power devices for fastening various construction materials and more particularly to devices which automatically control the spacing between consecutive fasteners such as nails, staples and screws.

BACKGROUND OF THE INVENTION

The construction industry has many requirements for fastening one material to another using nails, staples or screws. Power fasteners manufactured by companies such as SENCO (Senco is the trademark of Senco Products, Inc., Cincinnati, Ohio USA), HITACHI (Hitachi is the trademark of Hitachi, Ltd., Tokyo, Japan)and BOSTICH (Bostich is the trademark of The Stanley Works, New Britain, Conn. USA) are used to drive various fasteners through one material and into another to hold the two materials in a fixed position with respect to one another. The fastening of roof sheeting to the trusses of a house using nails or staples is one example. The distance or spacing between adjacent fasteners is the "schedule" for specific fastening applications. This schedule may be defined by a code such as the Uniform Building Code or by the specification of the contractor. The schedule for a given application is very critical since the schedule affects the structural integrity of the joined materials.

The power fasteners currently available leave the spacing or distance between adjacent fasteners (the "schedule") to the trained eye of the operator. The operator operates a trigger mechanism to drive the fastener into the materials after he or she has navigated the power fastener to the proper location. A safety mechanism prevents the power fastener from driving a fastener when the unit is not properly positioned relative to the surface of the construction material, or pre loaded. Other than seeing that the safety interlock is operated by placing the nose of the power fastener on the surface and depressing the interlock, an operator determines fastener location by pulling the trigger of the power fastener when the perceived proper location is achieved. It is obvious that where an operator is forced to judge the distance between adjacent fasteners, a great deal of variation can occur in the schedule for the same application. If the operator chooses a reduced spacing, a great deal of time and material may be wasted. If the operator errs by choosing an increased spacing, the structural integrity may be compromised.

Thus, as will appear, the present invention fulfills a long time need for a simple device which attaches to a power fastener and which automatically produces an equal spacing between the fasteners being driven as the power fastener is moved along the surface of the material being fastened. The present invention also fulfills a need for such a device which is incorporated into the power fastener itself.

BRIEF SUMMARY OF THE INVENTION

The present invention, an automatic fastener scheduler, disclosed herein is a device which, as will appear hereafter in a greater detail, attaches to a power fastener such as a HITACHI power nailer and automatically operates the fastener when the scheduler has moved a fixed distance from the last fastener installed. The distance or spacing between adjacent fasteners (the "schedule") is set in advance by the operator for a given application according to the specification for the application. Once the schedule has been set, the operator merely pulls the trigger and rolls the device along the path of the fasteners. The device automatically cycles the power fastener to drive fasteners according to the schedule set by the operator. The device can easily attach to a variety of power fasteners, therefore allowing the device to schedule nails, staples or screws depending upon the power fastener to which it is attached. The device can be fitted with a handle and remote trigger so that the operator can walk behind the device in an upright stance much like the operator of a walk-along lawn mower. The safety interlock feature of the power fastener is maintained and uninterrupted.

The invention also lends itself to being incorporated as a part of the power driving mechanism and safety features of a power fastener to operate as a complete "stand alone" device to automatically drive fasteners according to a set schedule.

The present invention, as will appear, is a rolling base equipped with provisions for the attachment of a standard power fastener for driving fastening products such as nails, staples or screws. The attachment arrangement of the power fastener to the present invention provides for ease of attachment and removal of the power fastener. Further, the power fastener, when removed from the invention, can be utilized independent without the automatic spacing feature while leaving the attachment clamps of the present invention still mounted to the power fastener. The wheels of the base allow an operator to roll the invention along lines where fastening products are required to be driven for the joining of two materials. A cam is rotationally and fixedly attached to at least one of such wheels in such a way that as the base is rolled, a cam follower causes the power fastener to be pivoted up and down. Because of the way in which the power fastener is attached to the rolling base, this up and down pivoting action operates the safety interlock of the-power fastener each time the power fastener is in a preselected position, i.e., the down position, and the safety interlock is in contact with the material to be joined. If the operator depresses the trigger of the power fastener at the time the safety interlock is opened by the operation of the cam and cam follower, a fastener is driven. The invention essentially "bumps" the power faster against the material at each location a fastener is required. The dimensions of the lobes of the cam are chosen to produce a travel or pivoting action sufficiently great to open the safety interlock each time the power fastener is "bumped" against the material. The spacing between adjacent fasteners along the line of attachment is determined by the circumference of the wheel or wheels which drive the cam and the number of lobes on the cam. Therefore, the fastener schedule can be adjusted to a required specification by installing drive wheels of the proper diameter. For example, a cam with two equally spaced lobes will drive two equally spaced fasteners for each rotation of the wheel. Therefore, a fastener spacing of 6" would require a drive wheel having a diameter of somewhat less than 4". The spacing between adjacent fasteners can also be adjusted by driving the cam at a different rotational speed than that of the wheel through the use of gearing or a pulley and timing belt system. For example, the above-described system of a two lobed cam and 4" diameter drive wheel could be caused to produce a fastener spacing of 12" by including a 2:1 reduction gearing arrangement between the drive wheel and the cam.

Although this description of present invention has focused on the application of the invention within the construction industry it is clear that the invention has application to any field in which a power device is used to join two or more materials with fasteners such as nails, staples or screws where such fasteners are required to be placed at fixed intervals, i.e. with a fastening schedule.

Accordingly, it is a primary object of the invention to provide a simple device which provides for the easy attachment and removal of a variety of power fasteners to automatically space adjacent fasteners according to a predetermined schedule as the invention is rolled along a path.

It is a further object of the invention to provide a simple device which can be incorporated into a complete "stand alone" power fastener which can automatically drive fasteners according to a predetermined fastening schedule.

These and further objects, as shall hereafter appear, are readily fulfilled by the present invention in a remarkably unexpected manner as will be readily discerned from the following detailed description of an exemplary embodiment thereof especially when read in conjunction with the accompanying drawings in which like parts bear like numerals throughout.

BRIEF DESCRIPTION OF THE DRAWINGS

In the drawings:

FIG. 6 is a side view of the invention with the near drive wheel removed to show the operation of the cam and cam follower while

DESCRIPTION OF THE PREFERRED EMBODIMENT

A brief description of an exemplary embodiment of the present invention is set forth herein in sufficient detail to allow a person skilled in the art to understand the operation and fully utilize the invention. The numbered parts of the description refer to the parts identified in the attached figures in which like parts bear like numerals throughout the invention.

Figure 1:
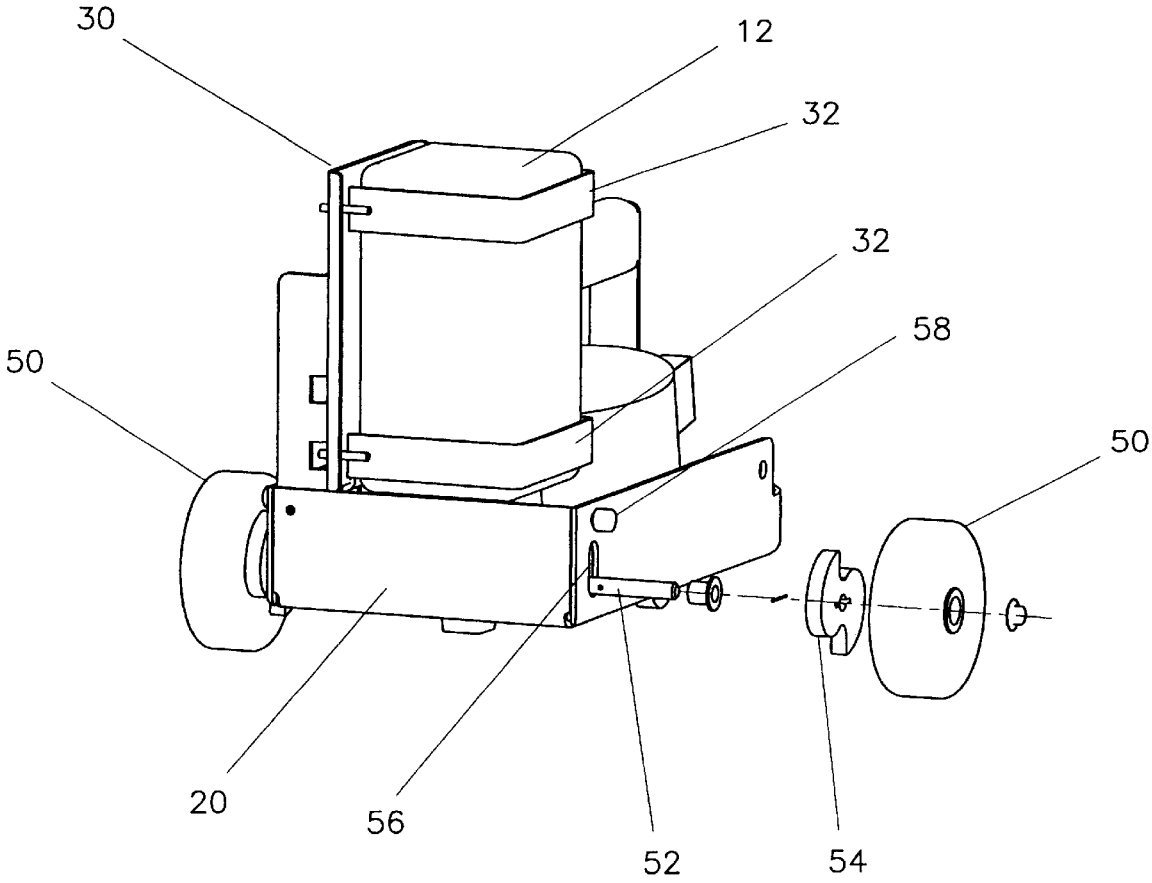
FIG. 1 is a partially exploded perspective front view of the invention.
Figure 2:
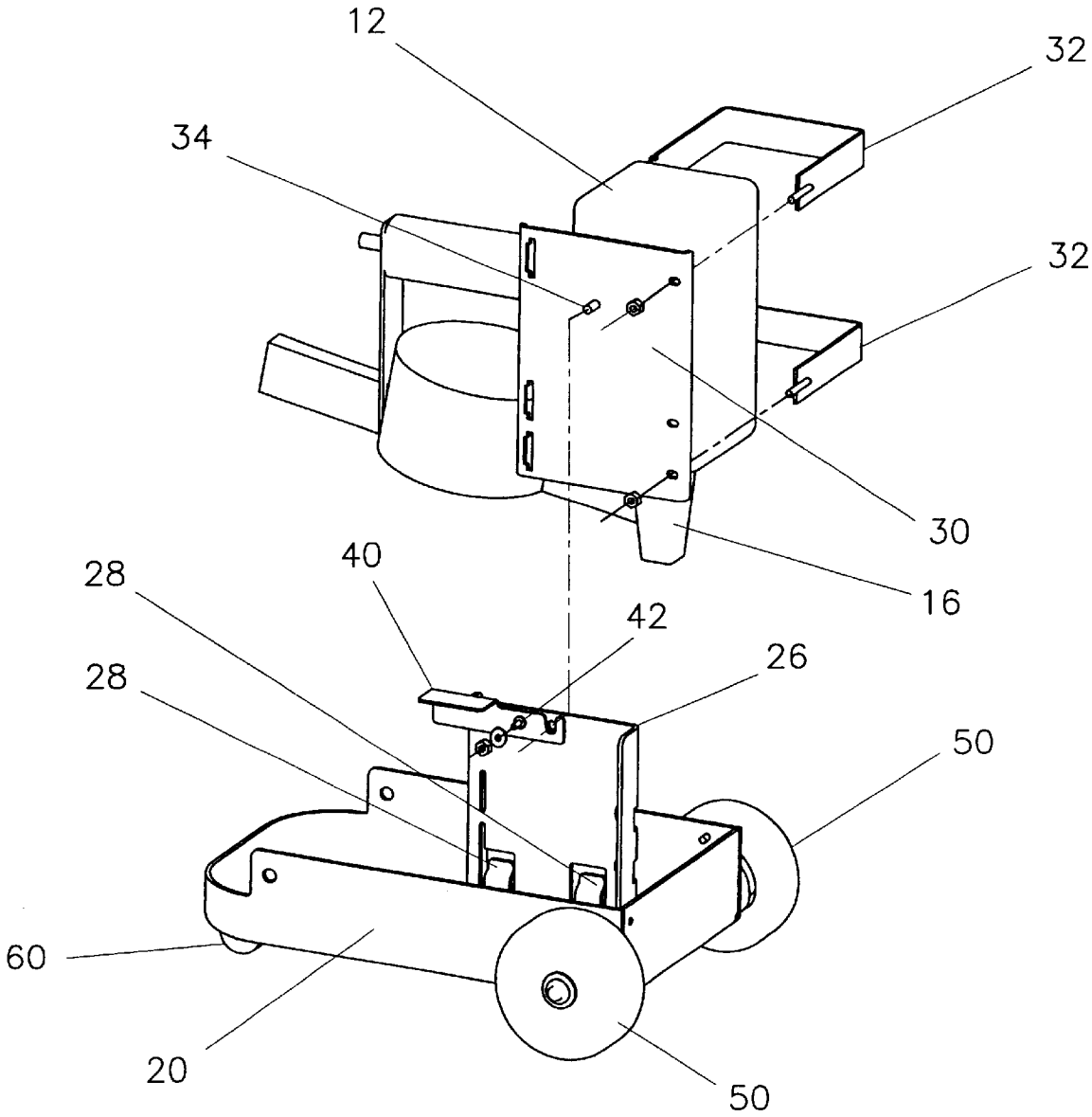
FIG. 2 is a partially exploded perspective side view of the invention.
Figure 3:
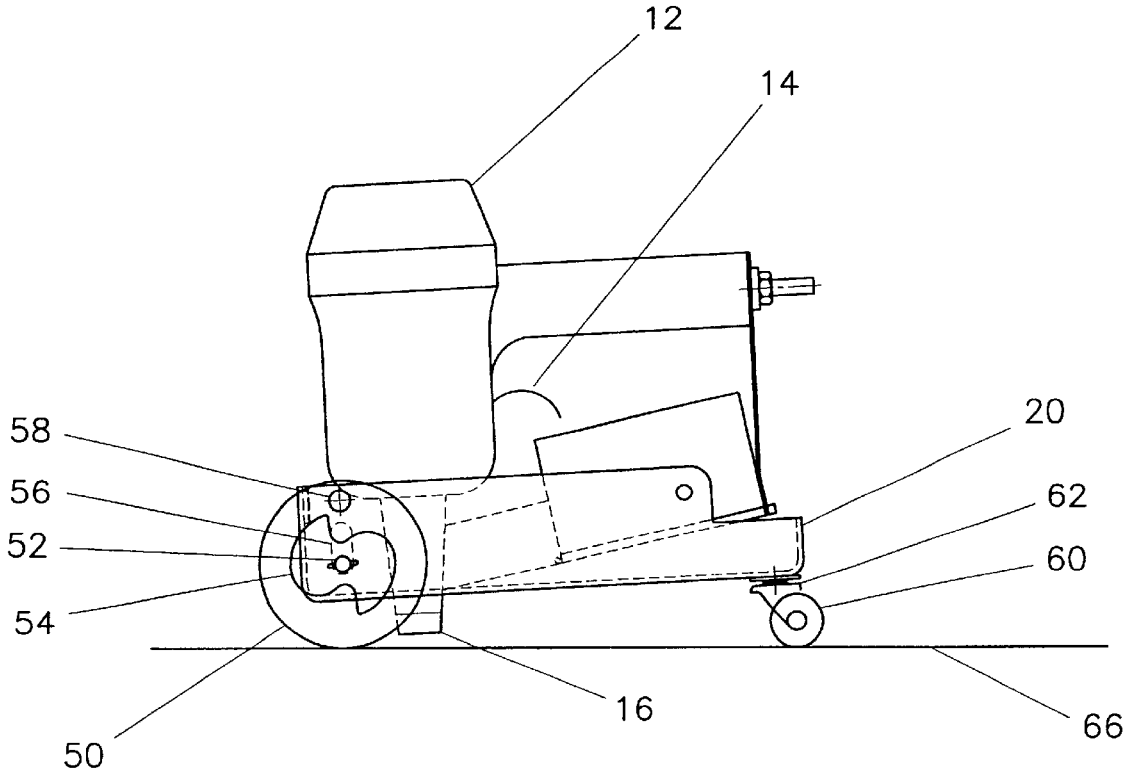
FIG. 3 is a side view of the invention.

As shown in FIG. 1, the device of the present invention, identified by the general reference 10, is comprised of a frame 20, which supports a power fastener 12. As shown in FIG. 2, the power fastener 12 is installed on the frame 20 by first attaching a mounting plate 30 to the power fastener using a pair of clamps 32. Clamps 32 are designed to fit the exact model of power fastener 12 being installed on the device. A latch post 34 is fixedly attached to mounting plate 30. An upright support 26 is fixedly attached frame 20. Upright support 26 includes retaining features 28 and a latch 40 which is free to rotate about pivot point 42. The entire assembly of power fastener 12, clamps 32 and mounting plate 30 is positioned on frame 20 using retaining means 28 and secured by latch 40 as it engages latch post 34. Referring to FIG. 3, the frame 20 is supported on the surface 66 of the material to be joined by a pair of measuring wheels 50 mounted on an axle 52, and a guide wheel 60. Axle 52 is free to rotate and is contained within slot 56 which is defined through frame 20. Wheel 60 is attached to frame 20 by swivel 62 and is free to rotate about a vertical axis. Measuring wheels 50 are removably attached to axle 52 but rotationally locked to axle 52. Cam 54 is attached to axle 52 and rotationally locked to axle 52 for rotation in one direction and free to rotate freely in the other direction. Cam follower 58 is fixedly attached to the vertical side of frame 20 and protrudes outward and perpendicular to frame 20.

Figure 4:
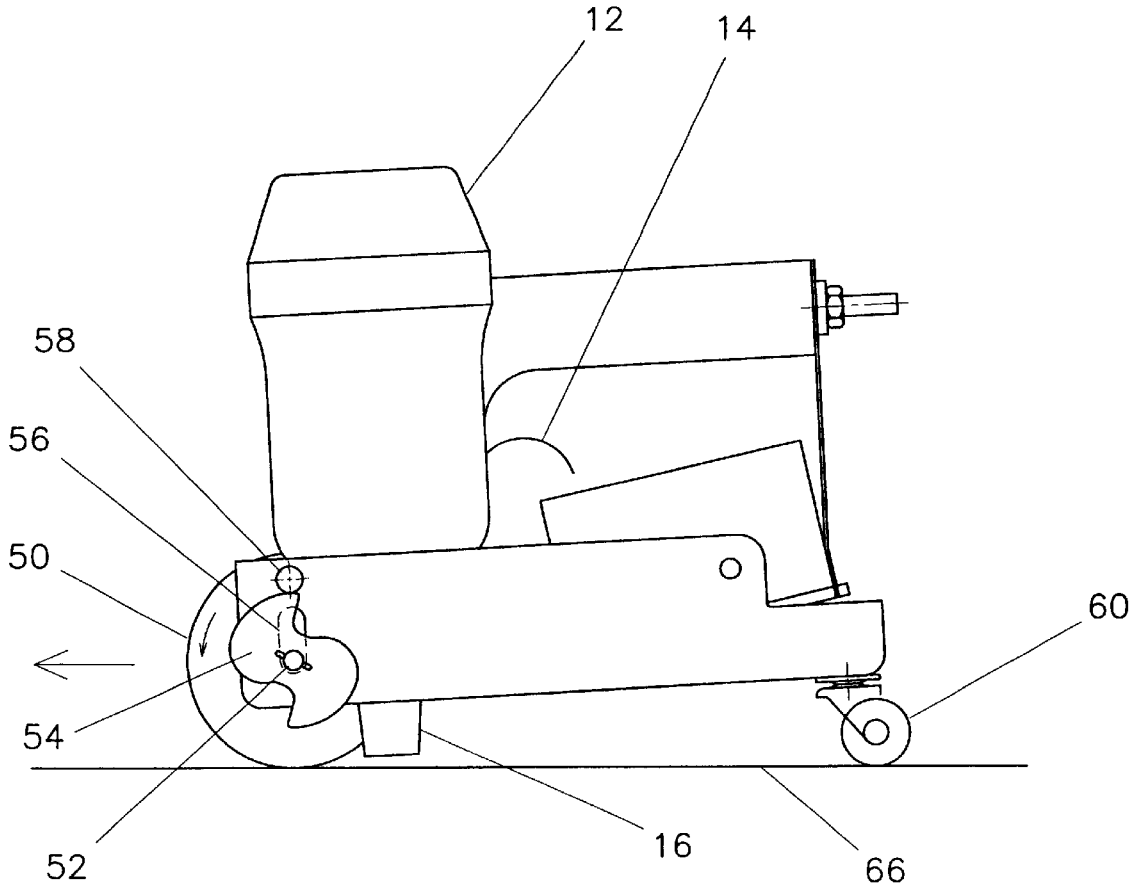
FIG. 4 is a side view of the invention with the near drive wheel removed to show the operation of the cam and cam follower with the power fastener shown in an up or non-driving position.

Referring to FIG. 4, as the frame 20 is rolled across the surface 66 of the material to be joined on the pair of measuring wheels 50 and a guide wheel 60, cam 56 is rotated against cam follower 58 forcing frame 20 to move upward guided in slot 56. The upward movement of frame 20 causes power fastener to rotate about guide wheel 60, thus moving the power fastener 12 upward and away from the surface 66. The expulsion end 16 of the power fastener 12 is not in contact with the surface 66 and therefore the safety interlock is not operated.

Figure 5:
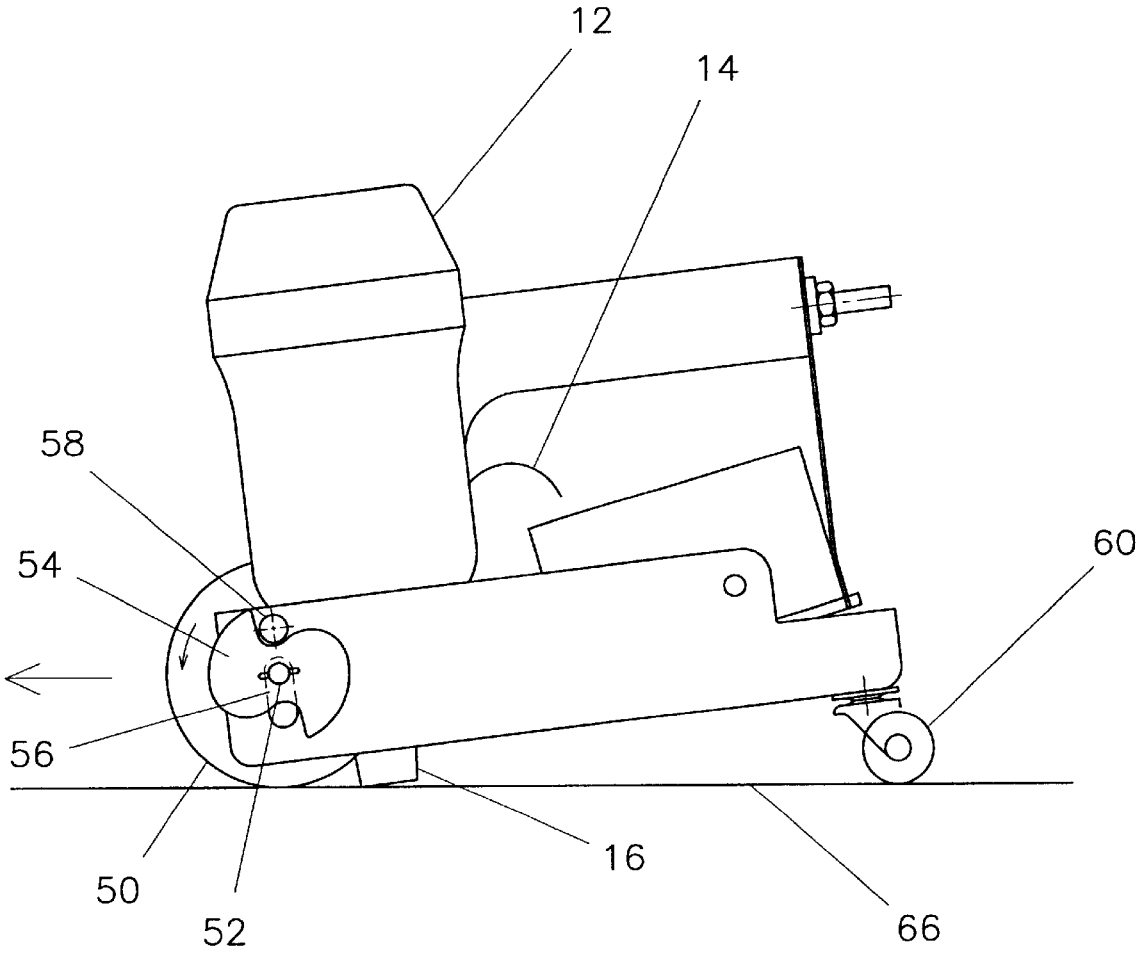
FIG. 5 is a side view of the invention with the near drive wheel removed to show the operation of the cam and cam follower with the power fastener shown in a down or fastener driving position.

Referring to FIG. 5, cam 54 is shown rotated through 90 degrees by the rolling of wheels 50 on surface 66. The expulsion end 16 of the power fastener 12 is now in contact with the surface 66 and the safety interlock is opened. If the operator has pulled trigger 14 of power fastener 12, a fastener will be driven into surface 66.

Figure 6:
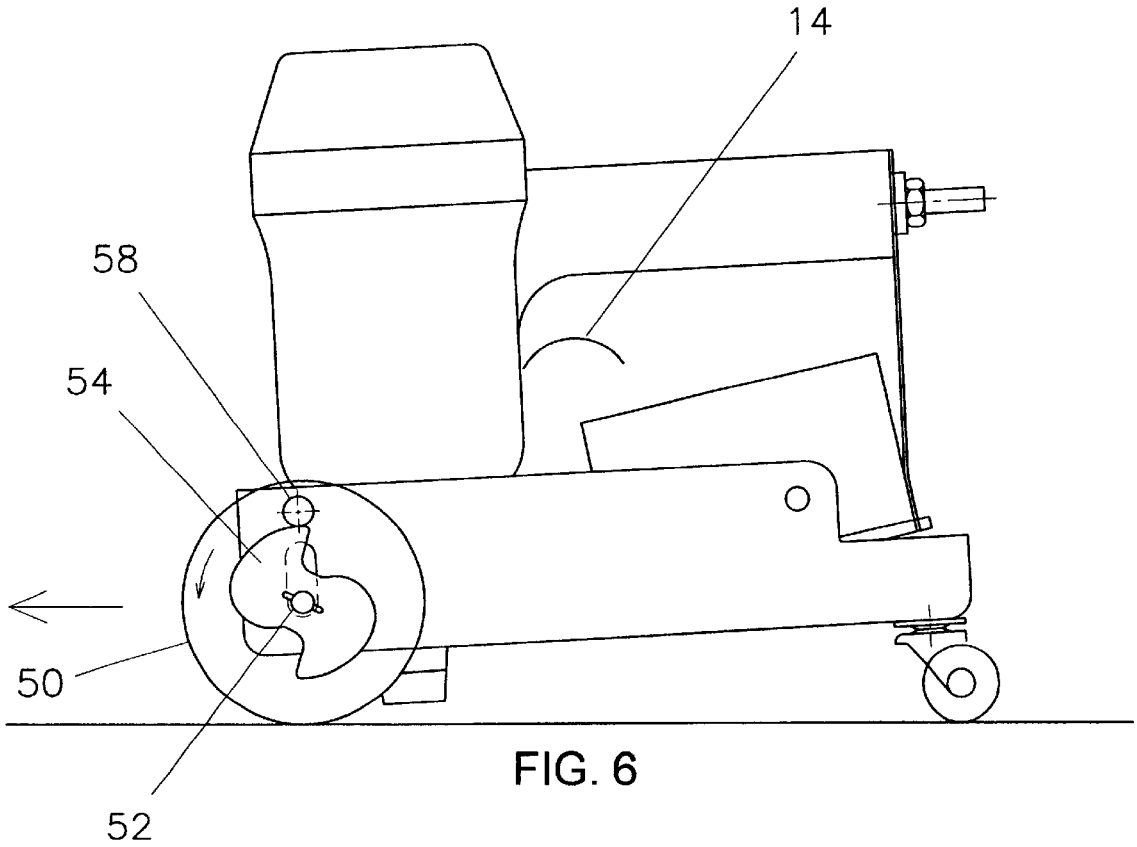
Figure 6A:
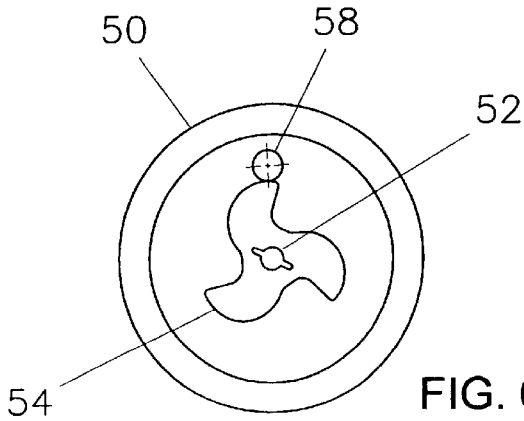
FIG. 6A shows an alternate wheel with a three lobed cam.

Referring to FIGS. 6 and 6A, a detail of a three lobed replacement cam 54A and larger diameter measuring wheel 50A are shown as FIG. 6A as alternatives to the two lobed cam 54 and smaller measuring wheel 50. When cam 54A is installed the device With this cam installed, the device 10 will drive 3 fasteners per rotation of measuring wheels 50, thereby reducing the spacing between adjacent fasteners as compared to when device 10 is operated with the two lobed cam 54 installed. The larger diameter wheel 50A on the other hand will serve to increase the spacing between adjacent fasteners.

Figure 7:
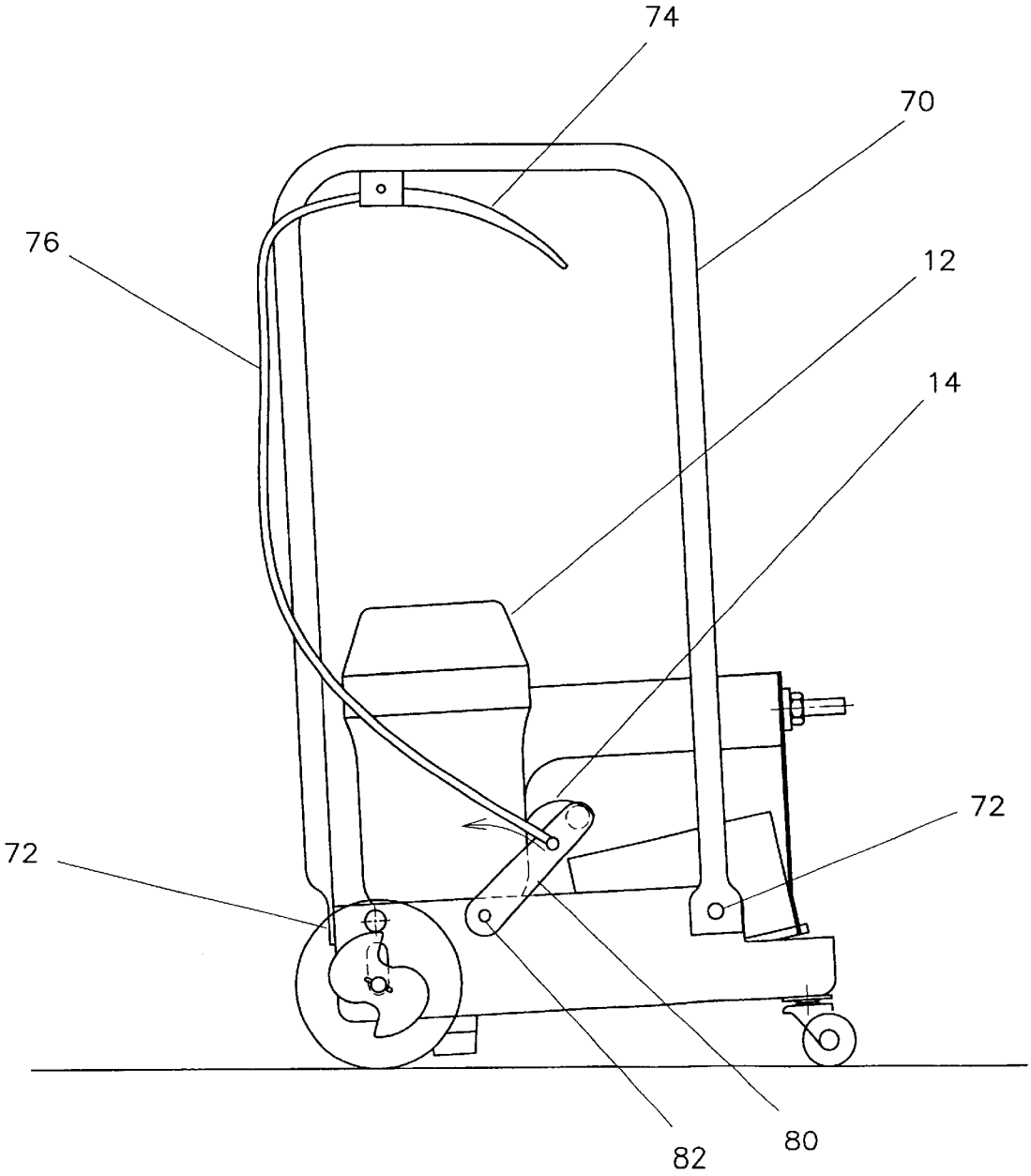
FIG. 7 is a side view of the invention showing the addition of a handle and extension of the trigger for operation in a crouched position.

Referring to FIG. 7, the device 10 is provided with an optional handle 70 installed on base 20 which allows an operator to operate device 10 while in a crouched position. Handle 70 is attached to frame 20 at attach points 72. A remote trigger 74 is attached to handle 70. A lever 80 is attached to frame 20 at pivot point 82. Remote trigger 74 is attached to lever 80 through cable 76 in such a fashion that a pull on remote trigger 74 will rotate lever 80. Lever 80 is installed on frame 20 at a location such that a rotation of lever 80 will engage trigger 14 of power fastener 12. In operation, the operator pulls on remote trigger 74 to actuate the trigger 14 of power fastener 12.

Figure 8:
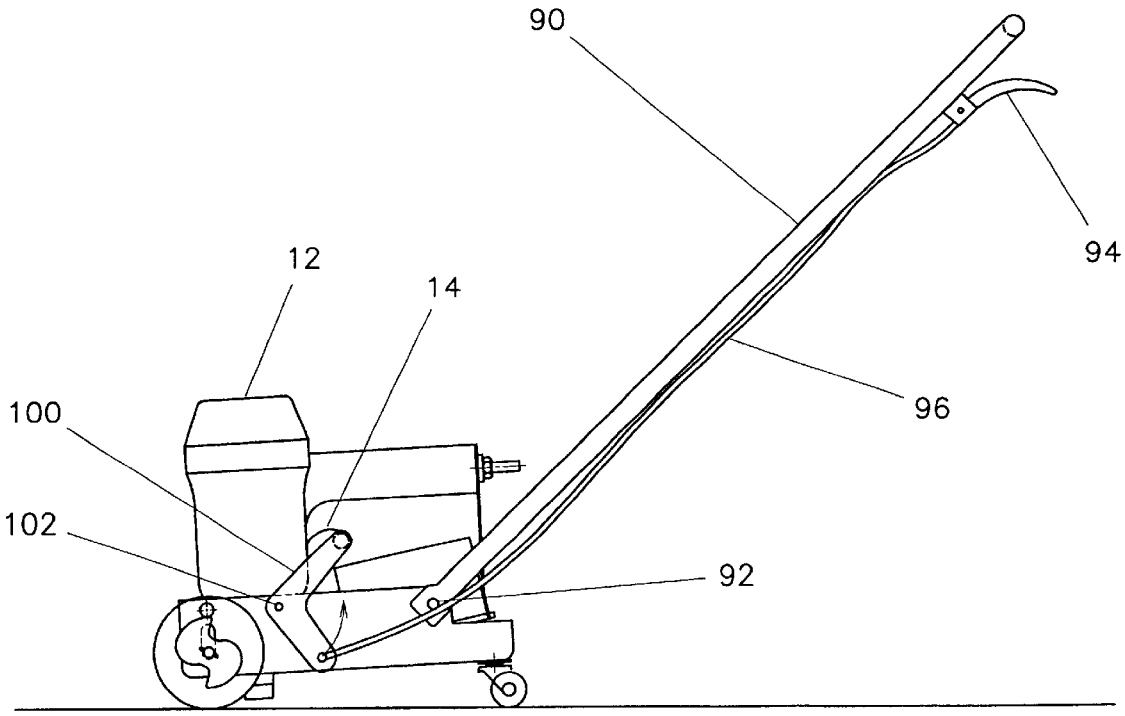
FIG. 8 is a side view of the invention showing the addition of a handle and extension of the trigger for operation in an upright walking position.

Referring to FIG. 8, the device 10 is provided with an optional handle 90 installed on base 20 which allows an operator to operate device 10 while in an upright position. Handle 90 is attached to frame 20 at attach points 92. A remote trigger 94 is attached to handle 90. A lever 100 is attached to frame 20 at pivot point 102. Remote trigger 94 is attached to lever 100 through cable 96 in such a fashion that a pull on remote trigger 94 will rotate lever 100. Lever

100 is installed on frame 20 at a location such that a rotation of lever 100 will engage trigger 14 of power fastener 12. In operation, the operator pulls on remote trigger 94 to actuate the trigger 14 of power fastener 12.

From the forgoing, it is readily apparent that a useful embodiment of the present invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only to the scope of the claims appended hereto.

Accordingly, what is claimed is:

1. An automatic fastening scheduler, comprising:

a frame capable of being releaseably attached to a power fastener, said frame comprising a first side and an opposing second side and a cam follower disposed on said first side, wherein said first side is formed to include a slot;

an axle having a first end and a second end, wherein said axle is disposed through said slot such that said first end extends outwardly from said first side and said second end extends outwardly from said second side and such that said axle is capable of moving upwardly and downwardly within said slot;

a first wheel attached to said first end;

a second wheel attached to said second end;

a cam attached to said axle and disposed between said first side and said first wheel;

wherein said cam follower remains in contact with said cam.

2. The automatic fastening scheduler of claim 1, wherein said cam comprises two lobes.

3. The automatic fastening scheduler of claim 1, wherein said cam comprises three lobes.

4. The automatic fastening device of claim 1, further comprising:

a handle attached to said frame and extending upwardly therefrom;

a remote trigger disposed on said handle;

a lever pivotably attached to said frame, wherein said lever is capable of engaging the trigger portion of a power fastener releaseably attached to said frame; and a cable interconnecting said remote trigger and said lever.

5. A method to schedule the operation of a power fastener, comprising the steps of:

providing a power fastener assembly comprising a power fastener releaseably attached to a frame, wherein said frame comprises:

a first side and an opposing second side and a cam follower disposed on said first side, wherein said first side is formed to include a slot having a first end and a second end;

an axle having a first end and a second end, wherein said axle is disposed through said slot such that said first end extends outwardly from said first side and said second end extends outwardly from said second side and such that said axle is capable of moving between said first end and said second end of said slot;

a first wheel attached to said first end of said axle;

a second wheel attached to said second end of said axle;

a cam attached to said axle and disposed between said first side and said first wheel, wherein said cam includes a plurality of cam lobe portions interspersed with non-lobe portions, and wherein said cam follower remains in contact with said cam;

moving said power fastener assembly along a line of attachment on a surface;

positioning said axle at said first end of said slot when said cam fastener contacts a cam lobe portion of said cam; and positioning said axle at said second end of said slot when said cam fastener contacts a non-lobe portion of said cam.

6. The method of claim 5, wherein said power fastener comprises an expulsion end, further comprising the step of contacting said surface with said expulsion end when said axle is moved to said second end of said slot.

7. The method of claim 6, wherein said power fastener further comprises a safety interlock, further comprising the step of opening said safety interlock when said axle is moved to said second end of said slot.

8. The method of claim 7, wherein said power fastener further comprises a trigger mechanism, further comprising the steps of:

pulling said trigger mechanism; and emitting a fastener from said power fastener when said axle is moved to said second end of said slot.

9. The method of claim 8, wherein said power fastener assembly further comprises:

a handle attached to said frame and extending upwardly therefrom;

a remote trigger disposed on said handle;

a lever pivotably attached to said frame, wherein said lever is capable of engaging the trigger portion of a power fastener releaseably attached to said frame; and a cable interconnecting said remote trigger and said lever;

said method further comprising the step of pulling said remote trigger.

10. The method of claim 5, further comprising the step of adjusting the circumference of said first wheel and said second wheel to alter the spacing between fasteners along said line of attachment.

11. The method of claim 5, further comprising the step of adjusting the number of lobes on said cam to alter the spacing between fasteners along said line of attachment.

12. The method of claim 5, further comprising the step of adjusting the rate of rotation of said cam with respect to the rate of rotation of said first wheel to alter the spacing between fasteners along said line of attachment.

* * * * *